US006989077B2

(12) United States Patent
Kurtz

(10) Patent No.: US 6,989,077 B2
(45) Date of Patent: Jan. 24, 2006

(54) WIDE NIP CALENDER ARRANGEMENT AND PROCESS FOR GLAZING A PAPER OR CARDBOARD WEB

(75) Inventor: Rüdiger Kurtz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 86 days.

(21) Appl. No.: 10/352,112

(22) Filed: Jan. 28, 2003

(65) Prior Publication Data

US 2003/0150339 A1 Aug. 14, 2003

(30) Foreign Application Priority Data

Feb. 14, 2002 (DE) ..... 102 06 333

(51) Int. Cl.
*D21F 3/04* (2006.01)
*D21G 1/00* (2006.01)

(52) U.S. Cl. ..... 162/205; 162/206; 162/358.3; 162/358.5; 162/360.2

(58) Field of Classification Search ..... 162/199, 162/203–207, 272, 118, 283, 136, 358.1, 162/358.3, 359.1, 360.2, 361, 358.5; 100/35, 100/38, 41, 153, 161, 162 R See application file for complete search history.

(56) References Cited

U.S. PATENT DOCUMENTS 4,370,923 A 2/1983 Schmidt
5,137,678 A * 8/1992 Hess et al. ..... 264/280
5,163,364 A * 11/1992 Bubik et al. ..... 100/38

(Continued)

FOREIGN PATENT DOCUMENTS

DE 2823738 12/1979

(Continued)

OTHER PUBLICATIONS

English Language Abstract of German Patent Application No. 41 24 940.

*Primary Examiner*—Eric Hug
(74) *Attorney, Agent, or Firm*—Greenblum & Bernstein, P.L.C.

(57) ABSTRACT

Wide nip calender arrangement and process for glazing a paper or cardboard web that includes a back pressure surface, a support shoe arrangement, and a circulating jacket loaded by the support shoe arrangement in a direction of the back pressure surface to form a wide nip. A moistening device is arranged before, relative to a web travel direction, an intake to the wide nip, and a calibration nip is arranged behind, relative to a web travel direction, a discharge from the wide nip. The instant abstract is neither intended to define the invention disclosed in this specification nor intended to limit the scope of the invention in any way.

26 Claims, 1 Drawing Sheet

U.S. PATENT DOCUMENTS

| | | | | | |
|---|---|---|---|---|---|
| 5,200,258 | A | * | 4/1993 | Tamagawa et al. | 428/218 |
| 5,483,873 | A | * | 1/1996 | Koivukunnas et al. | 100/38 |
| 5,914,008 | A | | 6/1999 | Winheim | |
| 6,022,448 | A | * | 2/2000 | Eriksson et al. | 162/123 |
| 6,213,009 | B1 | * | 4/2001 | Satman et al. | 100/38 |
| 6,260,481 | B1 | | 7/2001 | Winheim | |
| 6,287,424 | B1 | * | 9/2001 | Mohan et al. | 162/206 |
| 2003/0101880 | A1 | * | 6/2003 | Koivukunnas et al. | 100/161 |
| 2003/0150581 | A1 | * | 8/2003 | Lares et al. | 162/206 |
| 2004/0089434 | A1 | * | 5/2004 | Koivukunnas et al. | 162/205 |

FOREIGN PATENT DOCUMENTS

| | | | |
|---|---|---|---|
| DE | 4124940 | | 1/1993 |
| EP | 0451449 | | 10/1991 |
| EP | 0609544 | | 8/1994 |
| JP | 2000-314941 | * | 11/2000 |
| WO | WO 99/67462 | * | 12/1999 |
| WO | 01/55504 | | 8/2001 |
| WO | 01/83883 | | 11/2001 |
| WO | WO 01/83883 | * | 11/2001 |

* cited by examiner

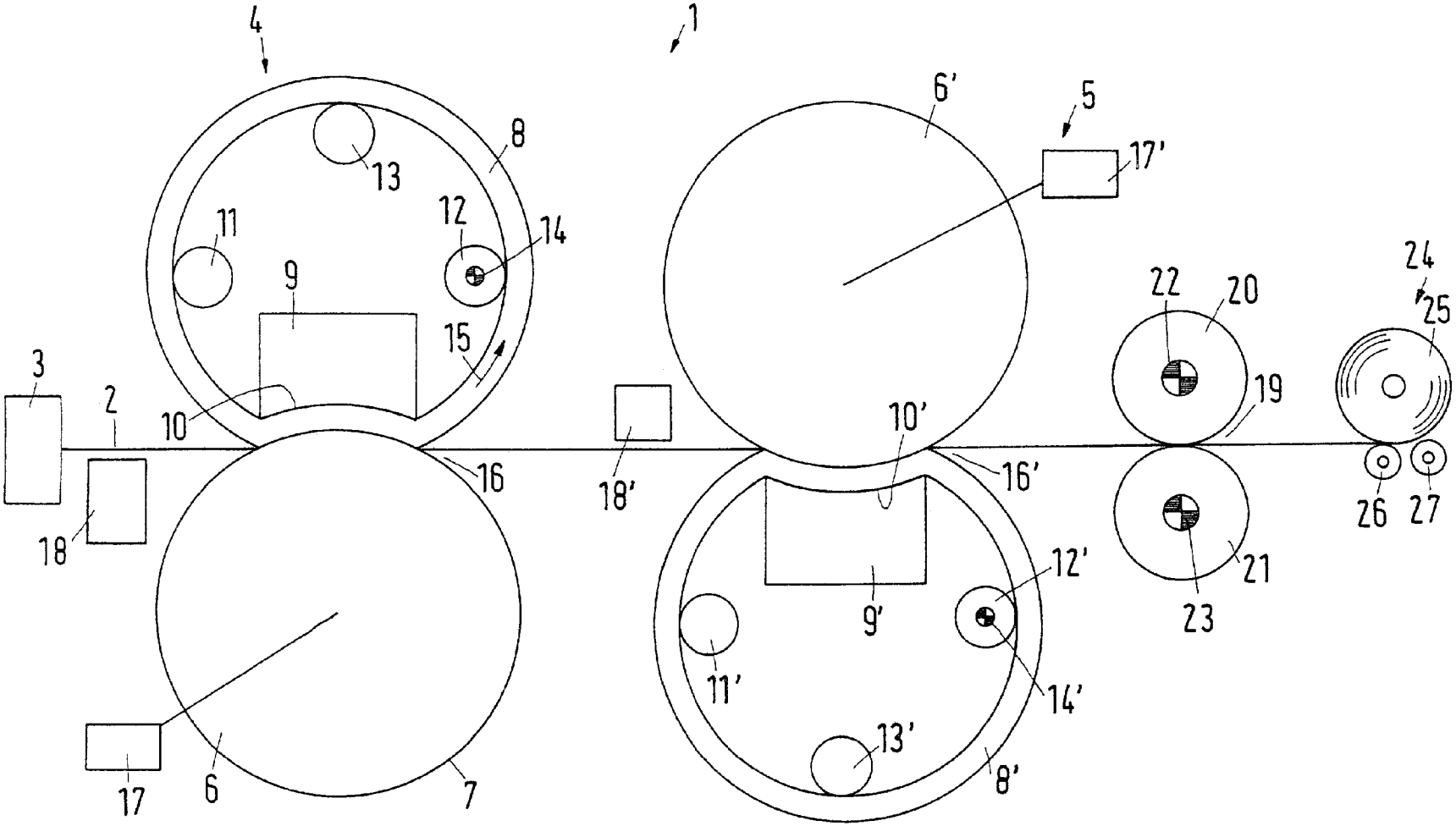
1
2
3
4
5
6
6'
7
8
8'
9
9'
10
10'
11
11'
12
12'
13
13'
14
14'
15
16
16'
17
17'
18
18'
19
20
21
22
23
24
25
26
27

WIDE NIP CALENDER ARRANGEMENT AND PROCESS FOR GLAZING A PAPER OR CARDBOARD WEB

CROSS-REFERENCE TO RELATED APPLICATIONS

The present application claims priority under 35 U.S.C. §119 of German Patent Application No. 102 06 333.8, filed on Feb. 14, 2002, the disclosure of which is expressly incorporated by reference herein in its entirety.

BACKGROUND OF THE INVENTION

1. Field of the Invention

The present invention relates to a wide nip calender arrangement for glazing a paper or cardboard web that includes at least one wide nip formed between a back pressure surface and a circulating jacket loaded by a support shoe arrangement in the direction of the back pressure surface, and a calibration nip. The invention further relates to a process for glazing a paper or cardboard web in which the paper or cardboard web is guided through a wide nip formed between a back pressure surface and a circulating jacket loaded by a support shoe arrangement in the direction of the back pressure surface, and the paper or cardboard web is calibrated.

2. Discussion of Background Information

In the manufacture of paper or cardboard webs, the situation frequently occurs that the paper or cardboard web exhibits a relatively nonuniform thickness across its width. Homogenizing this thickness in the paper machine is usually associated with a relatively large expense, so that it is preferred to homogenize the thickness in a calibration nip behind the paper machine. If the thickness were left nonuniform crosswise to the travel direction of the paper or cardboard web, problems would arise in the further handling of the paper or cardboard web. This can be observed in particular during reeling of the paper or cardboard web. If the paper web is thicker at one end (seen from the width direction) than at the other end, such clear differences in diameter occur with several hundred or even several thousand windings of a paper or cardboard roll, that this paper or cardboard roll can no longer be rolled up well and further processed.

For surface refining with a paper or cardboard web, it is preferred to use a wide nip press in which the paper or cardboard web can be acted on over a predetermined distance by low to increased pressure and, if necessary, also with an increased temperature with the object of keeping the loss in volume as low as possible during condensing. The wide nip press forms a wide nip in which a circulating jacket is opposite a back pressure surface. The jacket is pressed by a support shoe arrangement against the back pressure surface, so that a correspondingly greater or lesser pressure is exerted on the paper or cardboard web between the jacket and the back pressure surface. The wide nip has the advantage that the paper or cardboard web is acted on with pressure over a longer period. However, the compressive stresses in the wide nip are comparatively small, so that a volume-conserving glazing is possible.

In many cases it can be observed that the paper or cardboard web undergoes a powerful drying in the wide nip. Therefore, it has been suggested to arrange a moistening device before the wide nip, so as to moisten the paper or cardboard web. When the paper or cardboard web is more moist, its surfaces can also be smoothed better.

However, moistening has the disadvantage that it cannot be used together with the calibration calender that forms the calibration nip. When the paper or cardboard web is moistened again after calibration, i.e., after passing through the calibration nip, nonuniform thicknesses result across the width of the paper or cardboard web. This can possibly be attributed to the fact that the differences in thickness previously observed result again due to the swelling back of the areas condensed to differing extents.

SUMMARY OF THE INVENTION

The present invention glazes a paper or cardboard web without creating greater problems in further processing.

According to the invention, a wide nip calender arrangement of the type mentioned at the outset includes a moistening device arranged before the intake of the wide nip and the calibration nip is arranged behind the discharge of the wide nip.

With this arrangement, in which the paper or cardboard web is first moistened, then glazed and finally calibrated, it is possible to provide a paper or cardboard web with a uniform or at least almost uniform thickness across its width. Due to the normally lower surface tensions in the wide nip, this is not easily possible with a wide nip alone. Due to the moistening device before the wide nip and, above all, before the calibration as well, the paper or cardboard web can be provided with moisture without a negative impact on its thickness properties. The thickness is finally regulated only after glazing. Although certain disadvantages certainly also occur by "post-pressing" an already glazed web, these disadvantages can be tolerated because they are slighter than an arrangement of the calibration nip before the wide nip, when it is still being moistened between the calibration nip and the wide nip. Ultimately, the disadvantages of calibration in the calibration nip are limited to the fact that the paper or cardboard web gets isolated greasy or shinier spots on the surface than is the case only after passing through the wide nip. However, the paper or cardboard web also has a higher moisture than without moistening, so that it can be processed more easily.

The calibration nip is preferably formed by two hard rolls. The two hard rolls are arranged in a calender or machine in a manner which is known per se. The hard rolls, i.e., rolls of steel or cast iron without an elastic surface coating, are able to even out the thickness of the paper or cardboard web across its width. If it turns out that one calibration nip is not sufficient, it is possibly necessary to connect several calibration nips one behind the other. These calibration nips can then be arranged in a single roll stack so that several rolls can be used twice.

The back pressure surface is preferably formed by the surface of a hard roll. Since the jacket circulates, it is advantageous if the back pressure surface can circulate, too. This can be realized most easily in that the back pressure surface is formed by the circumferential surface of a roll. Since the smoothness of this roll is impressed in the paper or cardboard web, a particularly smooth roll is to be preferred here. This smoothness can be produced most easily on a hard roll, i.e., as discussed above, on a roll made of steel or cast iron.

The wide nip preferably features a heating device. If the paper or cardboard web is acted on in the wide nip not only with increased pressure, but also with increased temperature, glazing results can be improved. In particular, the paper or cardboard web can be given an increased smoothness and/or an improved gloss. The addition of heat in the wide nip renders it possible to act on the paper or cardboard web with increased temperature during virtually its entire throughput. This is more advantageous then when the paper or cardboard web is heated only before insertion into the wide nip.

Two wide nips are preferably arranged one behind the other and in front of the calibration nip, whereby first the one and then the other side of the paper or cardboard web comes into contact with a back pressure surface. In this way it is possible to glaze both sides of the paper or cardboard web in the same way, i.e., to give both sides of the paper or cardboard web a smoothness as provided by the back pressure surface.

It is particularly preferred here that a moistening device is arranged in front of each wide nip. The moisture losses that occur in every wide nip can thus be compensated for in advance, as it were. The paper or cardboard web thus remains easy to handle even after passing through the wide nip.

A moisture amount provided by the moistening device, the heating device, and the length of the wide nip are preferably adapted to one another such that the paper or cardboard web features at least the same moisture in the calibration nip as before the moistening device. The moisture losses that the paper or cardboard web undergoes in the wide nip are known and/or can be determined or calculated beforehand. When it is ensured that the moisture that is lost from the paper or cardboard web in the wide nip is applied beforehand, not only is an improved glazing of the paper or cardboard web obtained, i.e., an improved smoothness of the surface, but the paper or cardboard web itself does not dry out, which facilitates the further handling, in particularly during reeling.

A reeling device is preferably arranged following the calibration nip. This embodiment has the advantage that a paper or cardboard web is reeled up shortly after it is brought to the same thickness across its width. A paper or cardboard roll thus formed is of high quality and can be easily further processed later on.

Further, the process of the type mentioned at the outset includes moistening the paper or cardboard web before intake into the wide nip and calibrating after leaving the wide nip.

By calibrating the paper or cardboard web after running through the wide nip, the paper or cardboard web can be treated in the wide nip and provided with moisture without having to take into consideration the actual thickness or the differences in thickness of the paper or cardboard web. This facilitates the treatment in the wide nip. On the other hand it is ensured that after leading the wide nip the paper or cardboard web is subjected to an additional processing step, i.e., calibration. This calibration produces a paper or cardboard web with a uniform thickness in the width direction, so that this paper or cardboard web is produced with a good surface quality and excellent thickness properties.

The paper or cardboard web is preferably heated in the wide nip. The heating is one possibility of further improving the glazing results. Since moisture is applied before the wide nip, it can be ensured that drying out of the paper or cardboard web is prevented or at least limited so that no negative consequences ensue.

It is hereby particularly preferred that before intake in the wide nip at least as much moisture is applied as escapes from the paper or cardboard web again by the time it reaches a calibration nip. The paper or cardboard web can thus be calibrated with a relatively high moisture content, which facilitates the calibration.

The paper or cardboard web is preferably reeled after calibration. When the paper or cardboard web is reeled immediately after calibration, there is virtually no time available for the paper or cardboard web to be deformed again into a nonuniform distribution of thickness under the influence of environmental conditions, e.g., ambient moisture. Thus, a very homogenous wound reel is obtained, which can be further processed well later on.

The present invention is directed to a wide nip calender arrangement for glazing a paper or cardboard web that includes a back pressure surface, a support shoe arrangement, and a circulating jacket loaded by the support shoe arrangement in a direction of the back pressure surface to form a wide nip. A moistening device is arranged before, relative to a web travel direction, an intake to the wide nip, and a calibration nip is arranged behind, relative to a web travel direction, a discharge from the wide nip.

In accordance with a feature of the invention, the calibration nip can be formed by two hard rolls.

The back pressure surface may include a surface of a hard roll. Further, a heating device may be arranged to heat the wide nip. The heating device can be arranged to feed a heat transfer medium to the back pressure surface. Still further, the heating device can be arranged to heat a surface of the back pressure surface with one of eddy currents and infrared radiation.

The wide nip calender arrangement can also include a second wide nip, such that the wide nip and the second wide nip are arranged one behind the other in the web travel direction. The wide nip and the second wide nip can both be positioned before the calibration nip. The second wide nip can be formed in part by a second back pressure surface, and the wide nip and the second wide nip can be arranged such that the back pressure surface and the second back pressure surface contact opposite surfaces of the web. Moreover, a moistening device can be arranged before each wide nip.

According to a further feature of the invention, a moistening device can be arranged before the wide nip.

Further, a moisture device may be arranged before the wide nip, and a heating device can be arranged to heat the wide nip. An amount of moisture supplied by the moistening device, a temperature in the wide nip, and a length of the wide nip in the web travel direction may be adapted to one another such that a moisture amount in the web at the calibration nip is at least the same amount of moisture in the web before the moistening device.

According to still another feature of the present invention, a reeling device may be arranged to follow the calibration nip in the web travel direction.

In accordance with another feature of the instant invention, the circulating jacket can have a certain rigidity so as to circulate as a roll. Alternatively, the circulating jacket can be a soft elastic belt without stability of shape.

A moisture device can be located before the wide nip and structured and arranged to apply an amount of moisture to the web entering the wide nip to compensate for moisture losses in the web due to passing through the wide nip.

The present invention is directed to a process for glazing a paper or cardboard web that includes guiding the web through a wide nip formed between a back pressure surface and a circulating jacket loaded by a support shoe arrangement in a direction toward the back pressure surface, moistening the web prior to the wide nip, and calibrating the web after the wide nip.

According to a feature of the invention, the web may include one of a paper and a cardboard web.

In accordance with the invention, the process may also include heating the web in the wide nip.

Further, at least as much moisture can be applied to the web prior to the wide nip as escapes from the by the time it reaches the calibration nip.

In accordance with a further feature, the process may also include reeling the web after the calibration.

The process can also include guiding the web through a second wide nip arranged after the wide nip in a web travel direction. The web can be guided through the wide nip and the second wide nip before being calendered. Further, the second wide nip can be formed in part by a second back pressure surface, and the back pressure surface and the second back pressure surface may be arranged to act on opposite surfaces of the web. The process can also include heating the back pressure surface and the second back pressure surface. The heating can include heating a surface of the back pressure surface and a surface of the second back pressure surface with one of eddy currents and infrared radiation. Moreover, the heating can include feeding a heat transfer medium to the back pressure surface and the second back pressure surface.

In accordance with still yet another feature of the present invention, the moisture may be applied to the web entering the wide nip in an amount that corresponds to moisture losses in the web due to passing through the wide nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE illustrates a wide nip calender arrangement in accordance with the features of the instant invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A wide nip calender arrangement 1 for glazing a paper or cardboard web 2, which comes from a paper machine 3 (indicated in diagram form only), features a first wide nip press 4 and a second wide nip press 5. First wide nip press 4 features a hard roll 6 with a surface 7 of steel or cast iron, which interacts with a circulating jacket 8, which is pressed against roll 6 via support shoe arrangement 9. Support shoe arrangement 9 features a concave contact surface 10, the curve of which is adapted to the curve of surface 7 of roll 6. Jacket 8 is guided over support reels 11, 12, and 13, of which support reel 12 can include a drive, in order to drive jacket 8 in the direction of arrow 15.

Jacket 8 can thereby feature a certain rigidity, so that it circulates in the manner of a roll. It can also be very "soft" and elastic, so that it forms virtually only a belt without its own stability of shape.

Jacket 8 and roll 6 are arranged together to form a wide nip 16. Wide nip 16 has a length in a web run direction of about 50 to 250 mm. Accordingly, paper or cardboard web 2 running through wide nip 16 is acted on during throughput with increased pressure over a predetermined period. The period is considerably longer than with throughput through a nip that is formed between two rolls.

Roll 6 is provided with a heating device 17 (only diagrammatically illustrated). Heating device 17 can be formed to feed, e.g., a heat transfer medium in the form of hot water, hot oil or hot steam to roll 6. However, it is also possible that heating device 17 heats only the surface of roll 6, e.g., by infrared radiation or eddy currents.

A moistening device 18 is arranged before an intake into wide nip 16, in order to apply moisture to that side of paper or cardboard web 2 that rests on surface 7 of roll 6 in wide nip 16. Moisture application can now be controlled by moistening device 18 such that, after leaving wide nip 16, paper or cardboard web 2 has at least a same moisture as before moistening by moistening device 18. In other words, the losses of moisture occurring in wide nip 16 can be compensated for in advance. Furthermore, this advance compensation has the advantage that the surface of paper or cardboard web 2 can be better smoothed because it is more moist.

A second wide nip press 5 is in principle constructed in the same manner as first wide nip press 4. Therefore, its elements are provided with the same reference numbers, but with the prime (') sign. The only difference is that the arrangement of roll 6' and jacket 8' is inverted, so that the other side of paper or cardboard web 2 rests on roll 6', whereas the side of paper or cardboard web 2 that previously rested on surface 7 of roll 6 rests on jacket 8'.

Here, too, a moistening device 18' is provided before intake into wide nip 16', whereby moistening device 18' applies moisture to the side of paper or cardboard web 2 which later rests on roll 6'.

Moreover, second wide nip press 5 can be omitted if only one side of paper or cardboard web 2 is to be given an increased smoothness. In such a case, the other side of paper or cardboard web 2 is smoothed by jacket 8 only, which in many cases is sufficient.

In every case, a calibration nip 19 is arranged behind wide nip 16 or behind wide nip 16' of second wide nip press 5. Calibration nip is formed by two hard rolls 20 and 21, each of which includes a drive 22 and 23. Rolls 20 and 21 are arranged in or mounted on a calender support (not shown in further detail), and are preferably formed as sag compensation rolls having circulating jackets which are hard, i.e., made of steel. After running through calibration nip 19, paper or cardboard web 2 exhibits a thickness that is largely uniform across the width of paper or cardboard web 2 (in the FIGURE perpendicular to the drawing plane).

A reeling device 24 is arranged to follow calibration nip 19 to reel paper or cardboard web 2 into a paper or cardboard roll 25. Paper or cardboard roll 25 can rest or be formed on two king rolls 26 and 27 that can be driven. However, it is also possible to hold paper or cardboard roll 25 centrically.

The uniformity of the thickness of paper or cardboard web 2 after running through calibration nip 19 is great enough not to cause obstructions during reeling into a paper or cardboard roll 25. Paper or cardboard roll 25 can thereby be formed in a very uniform manner. It is given the desired circular cylindrical shape.

Although during throughput through calibration nip 19 slight deteriorations in the surface quality of the paper or cardboard web can possibly occur, these slight deteriorations can be tolerated, because the thickness of the paper or cardboard web is very uniform across its width.

Through the above-mentioned moistening of paper or cardboard web 2 by moistening device 18 or moistening devices 18 and 18', it is possible that paper or cardboard web 2 can be reeled with at least the same moisture as it had before moistening at moistening device 18. This eliminates the disadvantage that a paper or cardboard web that is too dry is hard to reel.

It is shown that paper or cardboard web 2 comes directly from paper machine 3. However, it can also come from another upstream source, e.g., an unwinder. A circulating, hard belt can also be considered as a back pressure surface, that is supported on the side opposite the jacket by a support shoe arrangement.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A wide nip calender arrangement for glazing a paper or cardboard web comprising:

a back pressure surface;

a support shoe arrangement;

a circulating jacket loaded by said support shoe arrangement in a direction of said back pressure surface to form a wide nip;

a moistening device arranged before, relative to a web travel direction, an intake to said wide nip;

a calibration nip arranged behind, relative to a web travel direction, a discharge from said wide nip; and a second wide nip, such that said wide nip and said second wide nip are arranged one behind the other in the web travel direction.

2. The wide nip calender arrangement in accordance with claim 1, wherein said calibration nip is formed by two hard rolls.

3. The wide nip calender arrangement in accordance with claim 1, wherein said back pressure surface comprises a surface of a hard roll.

4. The wide nip calender arrangement in accordance with claim 3, further comprising a heating device arranged to heat said wide nip.

5. The wide nip calender arrangement in accordance with claim 4, wherein said heating device is arranged to feed a heat transfer medium to said back pressure surface.

6. The wide nip calender arrangement in accordance with claim 4, wherein said heating device is arranged to heat a surface of said back pressure surface with one of eddy currents and infrared radiation.

7. The wide nip calender arrangement in accordance with claim 1, wherein said wide nip and said second wide nip are both positioned before said calibration nip.

8. The wide nip calender arrangement in accordance with claim 7, wherein said second wide nip is formed in part by a second back pressure surface, and said wide nip and said second wide nip are arranged such that said back pressure surface and said second back pressure surface contact opposite surfaces of the web.

9. The wide nip calender arrangement in accordance with claim 1, further comprising a moistening device arranged before each wide nip.

10. The wide nip calender arrangement in accordance with claim 1, further comprising a moistening device arranged before said wide nip.

11. The wide nip calender arrangement in accordance with claim 1, further comprising:

a heating device arranged to heat said wide nip, wherein an amount of moisture supplied by said moistening device, a temperature in said wide nip, and a length of said wide nip in the web travel direction are adapted to one another such that a moisture amount in the web at said calibration nip is at least the same amount of moisture in the web before the moistening device.

12. The wide nip calender arrangement in accordance with claim 1, further comprising a reeling device arranged to follow said calibration nip in the web travel direction.

13. The wide nip calender arrangement in accordance with claim 1, wherein said circulating jacket has a certain rigidity so as to circulate as a roll.

14. The wide nip calender arrangement in accordance with claim 1, wherein said circulating jacket is a soft elastic belt without stability of shape.

15. The wide nip calender arrangement in accordance with claim 1, said moistening device being structured and arranged to apply an amount of moisture to the web entering said wide nip to compensate for moisture losses in the web due to passing through said wide nip.

16. A process for glazing a paper or cardboard web comprising:

guiding the web through a wide nip formed between a back pressure surface and a circulating jacket loaded by a support shoe arrangement in a direction toward the back pressure surface;

moistening the web prior to the wide nip;

guiding the web through a second wide nip arranged after the wide nip in a web travel direction; and calibrating the web after the wide nip.

17. The process in accordance with claim 16, wherein the web comprises one of a paper and a cardboard web.

18. The process in accordance with claim 16, further comprising heating the web in the wide nip.

19. The process in accordance with claim 16, wherein at least as much moisture is applied to the web prior to the wide nip as escapes from the by the time it reaches the calibration nip.

20. The process in accordance with claim 16, further comprising reeling the web after the calibration.

21. The process in accordance with claim 16, wherein the web is guided through the wide nip and the second wide nip before being calendered.

22. The process in accordance with claim 16, wherein the second wide nip is formed in part by a second back pressure surface, and the back pressure surface and the second back pressure surface are arranged to act on opposite surfaces of the web.

23. The process in accordance with claim 22, further comprising heating the back pressure surface and the second back pressure surface.

24. The process in accordance with claim 23, wherein the heating comprises heating a surface of the back pressure surface and a surface of the second back pressure surface with one of eddy currents and infrared radiation.

25. The process in accordance with claim 23, wherein the heating comprises feeding a heat transfer medium to the back pressure surface and the second back pressure surface.

26. The process in accordance with claim 16, wherein the moisture is applied to the web entering the wide nip in an amount that corresponds to moisture losses in the web due to passing through the wide nip.

* * * * *